United States Patent [19]

Melhuish

[11] Patent Number: 4,557,524

[45] Date of Patent: Dec. 10, 1985

[54] MINING MACHINE DUCT WORK ARRANGEMENT

[75] Inventor: James J. Melhuish, Franklin, Pa.

[73] Assignee: Joy Manufacturing Company, Pittsburgh, Pa.

[21] Appl. No.: 547,152

[22] Filed: Oct. 31, 1983

[51] Int. Cl.[4] ..... E21F 1/06; E21C 27/24

[52] U.S. Cl. ..... 299/64; 98/50; 299/12

[58] Field of Search ..... 299/12, 64; 98/50

[56] References Cited

U.S. PATENT DOCUMENTS

| | | | |
|---|---|---|---|
| 2,100,178 | 11/1937 | White | 262/28 |
| 3,258,848 | 7/1966 | Watlington | 34/99 |
| 3,712,678 | 1/1973 | Amoroso | 299/68 |
| 3,743,356 | 7/1973 | Sheets | 299/18 |
| 3,792,568 | 2/1974 | Gundlach | 55/223 |
| 3,810,677 | 5/1974 | David | 299/64 |
| 4,076,315 | 2/1978 | Gundlach et al. | 299/64 |
| 4,289,509 | 9/1981 | Hölter | 299/12 |
| 4,380,353 | 4/1983 | Campbell et al. | 299/12 |
| 4,463,973 | 8/1984 | Westphal | 299/12 |

*Primary Examiner*—Stephen J. Novosad

*Assistant Examiner*—M. Goodwin

*Attorney, Agent, or Firm*—Raymond W. Augustin

[57] ABSTRACT

A mining machine is disclosed which has a vehicle body with a first end thereof having a boom pivoted for up and down rotational movement about an axis extending transversely of the vehicle. A cutter head is carried by the boom and a conveyor is mounted on the vehicular body to carry away material cut by the cutter head. A dust collection system is mounted on the boom and vehicle body to convey dust away from the cutting head area. The dust control system has duct work associated therewith which includes a generally rectangularly intake duct section associated with the boom and a generally rectangularly fixed duct section mounted on the vehicle. A transition section connects the intake and the fixed duct sections. The transition section consists of a two piece arrangement wherein each piece is hinged to the intake duct section and is capable of slidingly engaging the fixed duct section at the end thereof adjacent the boom to sealing couple the intake duct section to the fixed duct section as the boom swings upwardly and downwardly.

13 Claims, 5 Drawing Figures

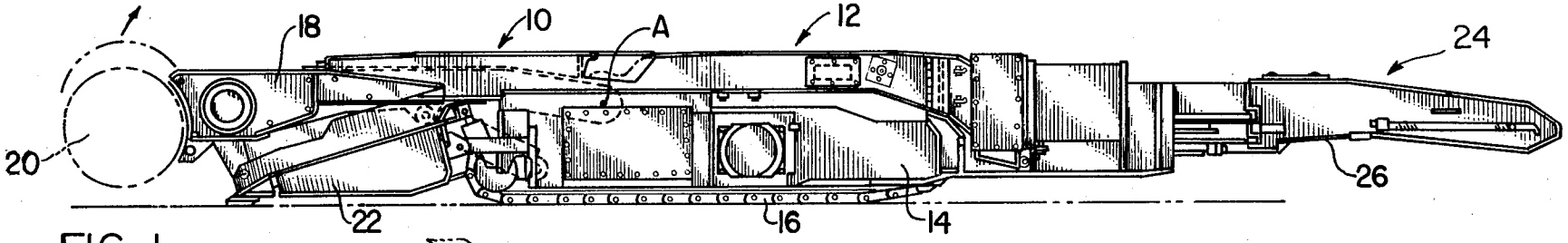
FIG. 1
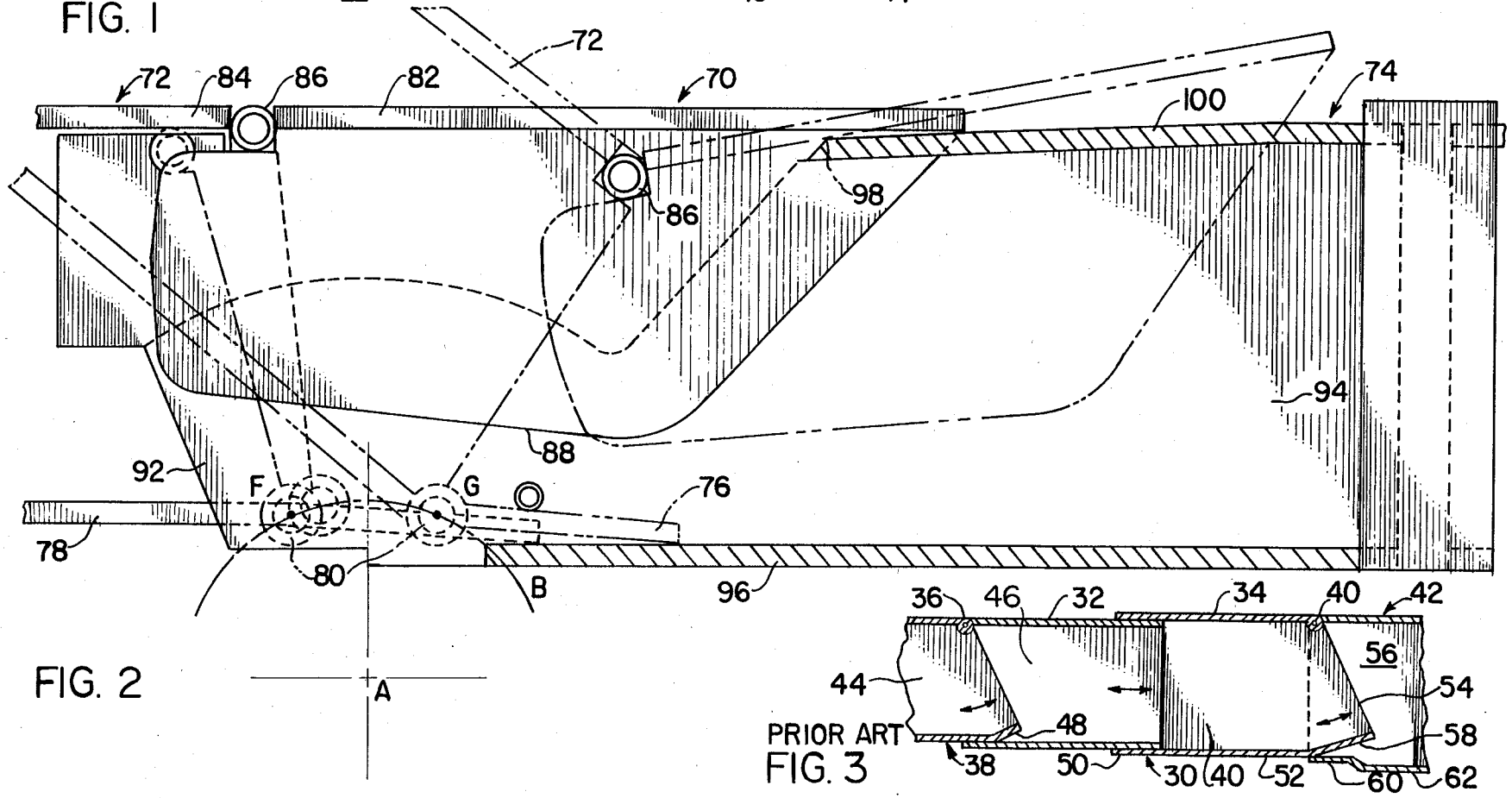
FIG. 2
PRIOR ART
FIG. 3

MINING MACHINE DUCT WORK ARRANGEMENT

BACKGROUND OF THE INVENTION

1. Field of the Invention

This invention relates to a dust control system for controlling dust generated by the operation by a mining machine, and more particularly to a transition section for connecting a pivoting joint between two sections of the duct system used to convey the dust away from the cutting head of a continuous mining machine.

2. DESCRIPTION OF THE PRIOR ART

This invention is especially concerned with the problem of removing dust from the air in a mine in the vicinity of equipment which, in use in the mine, generates dust. It is particularly concerned with removal of dust from the air in the vicinity of the mine face caused by the cutter head of a continuous coal mining machine. The general description of such a dust control system and of a typical coal continuous mining machine is disclosed in U.S. Pat. No. 4,380,353 which disclosure is incorporated herein by reference.

The dust control system as described in U.S. Pat. No. 4,380,353 while in general functioning adequately has had assembly and operational problems in the area of the connection between the duct section mounted on the boom of the vehicle, which boom swings upwardly and downwardly, and the fixed duct section which is mounted on the vehicle body. The disadvantages of the prior art transition sections are that a great deal of turbulence within the duct section is created because of the shape of the prior art transition sections. This can be seen in FIG. 13 of U.S. Pat. No. 4,380,353 wherein the area 95 and 105 the transition duct section is not smooth. In addition air leakage out of the duct system at the transition section was higher than desired with the concomitant loss of dust prior to the downstream scrubbing system.

Also fabrication and assembly of the prior art duct systems was much more difficult and costly than the transition section of the current invention since sliding telescoping ducts require tight dimensions in order to facilitate sealing while permitting ease of sliding. Also installation and maintenance of the prior art transition section was exceedingly difficult since the transition duct had to be installed integrally with the intake duct mounted on the boom and then assembled into the fixed dust transition. Replacement of the duct section because of the tight tolerances is difficult.

In the transition section of the present invention relatively loose tolerances can be maintained especially in the top and bottom portions of the transition section. The side portions must be maintained within reasonably close tolerances to prevent loss of dust laden air around the sides of the fixed duct at the end of the vehicle adjacent the boom. In order to perform maintenance on the duct design of the present invention all that is necessary is to remove two hinge pins and replace either of the only two parts which may have become worn or damaged.

There are other mining machines of the continuous mining type which disclose duct sections mounted thereon however no transition section of the type disclosed herein is taught or suggested. Such a machine is shown in U.S. Pat. Nos. 4,289,509, 3,743,356 and 4,076,315.

U.S. Pat. No. 3,810,677 discloses a dust collection system having a flexible duct arrangement rather than a duct arrangement having rigid rectangular cross section.

U.S. Pat. No. 3,258,848 discloses a transition section for air drying machine which applicant does not believe is analogous art to the mining machine and which in any event does not teach or suggest a transition section of the present invention.

SUMMARY OF THE INVENTION

An object of this invention is to provide a transition section between a fixed duct mounted on a mining vehicle body and an intake duct mounted on a mining vehicle swingable boom which sealingly couples the two duct sections while the boom swings upwardly and downwardly.

It is an additional object of this invention to provide a transition section which reduces turbulence in the transition area by providing a constant smooth cross section throughout the upward and downward motion of the boom.

It is yet an additional object of the invention to provide a coupling between a fixed duct mounted on a vehicle body and an intake duct mounted on a vehicle boom which is easy to fabricate, install and maintain.

It is yet a further object of this invention to provide a transition section connecting two generally rectangular ducts which provide adequate sealing in the area pivot connection between a fixed duct and a swingable intake duct portion.

These and other objects of the present invention are provided for in a mining machine of the type having a vehicle body with a first end thereof having a boom pivoted for up and down swinging movement about an axis extending transversely of the vehicle. A cutter head is carried by the boom and a conveyor means extends longitudinally along the vehicle body for conveying materials toward a second end of the vehicle. The cutter head, when operated to cut material such as coal, causes dust to be present in the air at the first end of the vehicle in the area of the boom and cutter head. The machine includes a dust control system which includes a generally rectangular duct system having an intake duct section associated with the boom and swingable up and down with the boom. A generally rectangular fixed duct section extends longitudinally along the vehicle along side the conveyor. A transition duct section connects the intake duct and the fixed duct sections in the area where the boom pivots about the vehicle body. The transition section has a bottom plate hinged to the bottom surface of the intake duct section and this plate is capable of having the end thereof opposite the hinged end slide on the bottom surface of the fixed duct section. This sliding plate seals the bottom of the transition area of duct system as the boom rotates upwardly and downwardly. The transition section has a top plate which is hingedly connected to the top surface of the intake duct and is capable of slidingly engaging the top surface of the fixed duct section as the boom rotates upwardly and downwardly. This top plate seals the top area of the transition section. The top plate has side plates fixed thereto which extend downwardly therefrom. These side plates slidingly engage the side surfaces of the intake duct section and the fixed duct section in the area of the transition sealing at least the top portion of the sides of the duct section in the transition area. The fixed duct section has a bottom side portion extending therefrom. These side portions extend around the bottom plate of the transition section and engage the outer sides of the intake duct section for sealing the duct system in the bottom side area of the transition section.

Other objects and features will be in part apparent and in part pointed out hereinafter.

BRIEF DESCRIPTION OF THE DRAWINGS

FIG. 1 is an elevation view of the mining machine including the dust transition section of the present invention.

FIG. 2 is an enlarged sectional view of the duct transition section shown in FIG. 1 with the boom in both the lower and upper positions.

FIG. 3 discloses a prior art embodiment of a telescoping transition section.

DESCRIPTION OF THE PREFERRED EMBODIMENT

Figure 5:
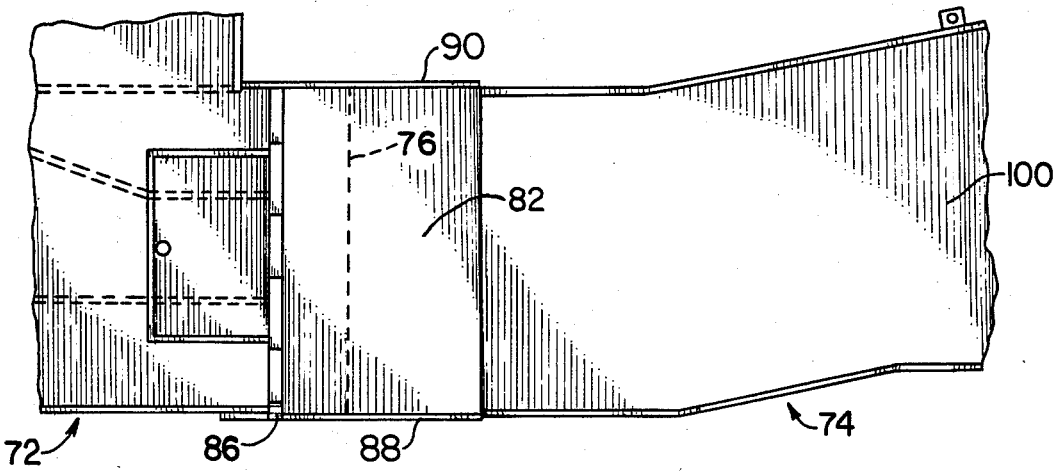
FIG. 5 is a plan view of the mining machine shown in FIG. 1 including the duct transition section of the present invention.

Referrring first to FIGS. 1 and 5 there is generally indicated at 10 a mining machine and at 12 the dust control system mounted on the mining machine. The mining machine shown is a conventional commercially available continuous mining machine which comprises a vehicle 14 on caterpillar treads 16. The machine has at one end, constituting its forward end, a cutter boom 18 pivoted for up and down swinging movement about an axis indicated at A in FIGS. 1 and 2. The boom extends forward from the vehicle and carries at its forward end a cutting means, referred to as a cutter head 20, adapted to cut material to be mined and more particularly coal, from the working face of a mine.

Also entending forward from the vehicle at its forward end, below the cutter boom, is an apron 22 on which coal cut from the working face by the cutter head 20 is gathered and delivered to a conveyor 24 which extends longitudinally of the vehicle with a rearward overhanging extension 26, for conveying coal back towards the rear end of the vehicle and then via extension 26 to a shuttle car (not shown), the coal falling off of the rearward end of the conveyor into the car.

A general description of a typical dust suppression or collection system is described in U.S. Pat. No. 4,380,353. This description is incorporated herein by reference.

As can be best seen in FIG. 3 one prior art transition duct section (also shown in U.S. Pat. No. 4,380,353) consist of a telescoping duct section generally denoted as 30 and comprises a forward duct member 32 telescopically slidable in a rearward duct member 34. The forward duct member 32 is hinged as indicated at 36 at its forward upper edge to the rearward upper edge of the outlet of the air intake section 38. The rearward duct member 34 is hinged as indicated at 40 at its rearward upper edge to the forward upward edge of the fixed duct section 42. The outlet 38 of the air intake section has side portions 44 at its rearward end slidable on the inside of the side 46 of the forward duct member 32 and a curved bottom portion 48 at its rearward end slidable in the forward edge 50 of the bottom 52 of the forward duct member maintaining an adequate air seal between outlet 38 and member 32 as the outlet 38 swings up and down with the cutter boom 18. The rearward duct member 34 of the telescoping duct section 30 has side portions 54 at its rearward end slidable on the inside of the sides 56 of the fixed duct section 42 at the forward end of duct section 42, and curved bottom portions 58 at its rearward end slidable at the forward edge 60 of the bottom 62 of the fixed duct section 42 maintaining an adequate air seal between member 34 and section 42 as member 34 swings up and down as a result of the boom 18 swinging up and down. The portions 48 and 58 cause a great deal of turbulence as the dust laden air is drawn through the duct system. It can be seen that tight tolerances must be maintained in this design to provide sealing of the telescoping sections while still allowing the section to slide.

Figure 4:
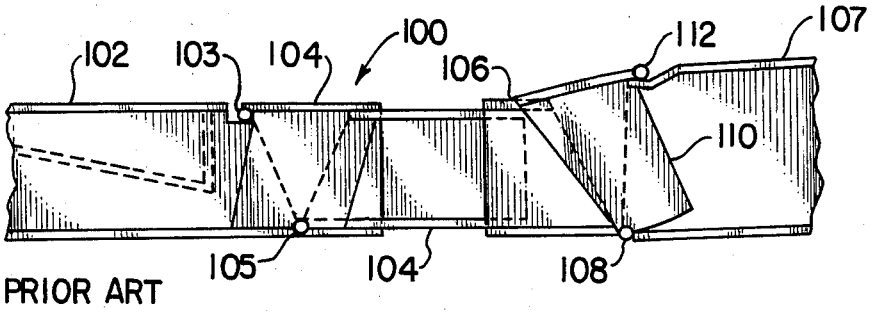
PRIOR ART FIG. 4
FIG. 4 shows a second prior art embodiment of the same duct transition section.

An alternate prior art design as shown in FIG. 4 wherein the transition consists of a generally rectangular duct section generally denoted as 100 hingedly coupled to the intake duct 102 by hinges 103 and 105. Transition member 100 surrounds one end of the intake duct 102 and one end of a telescoping section generally denoted as 104. The telescoping section 104 is hingedly connected to the bottom of the intake duct 102 at hinge point 105 and to the top of the section 102 at point 103. The telescoping duct 104 has its other end slidingly received within a third transition section generally denoted as 106. The third transition section 106 is hingedly connected to the fixed duct section 107 at point 108. The telescoping section is hinged to the intake duct at hinge point 105 and slides in a telescoping manner within the third duct portion 106. A fourth duct section 110 is pivoted to the fixed duct section at hinge point 108 and 112. The fourth duct section is positioned to seal the gap between the third hinge duct section and the fixed duct section as the boom swings upward and downward. As the boom swings upwardly or downwardly the movement of hinge points 103 and 105 causes the telescope action of duct 104 within duct 106. It can be seen that many parts are required and that the telescoping duct 104 and duct 106 have to have outer and inner dimension maintained within rigid tolerances in order for the telescoping action to smoothly occur while still sealing the system.

As can be best seen in FIGS. 2 and 5 the preferred transition section, generally denoted as 70, is utilized to seal the area where the intake duct 72 and the fixed duct section 74 are in pivotal relation ie. at the boom pivot point A. As can be seen in FIG. 2 the preferred transition section has a bottom plate 76 hingedly connected to the bottom plate 78 of rectangular duct 72 by hinge joint 80. In the preferred embodiment the hinge is a piano type hinge which runs entirely across the width of the duct 72.

In the preferred embodiment the transition section includes an upper plate 82 which is hingedly connected to the upper plate 84 of the intake duct section 72 at hinge joint 86. Again, the preferred hinge joint 86 is a piano type hinge which runs the entire width of the rectangular intake duct 72. In the preferred embodiment top plate 82 has two side plates 88 and 90 extending downwardly therefrom to provide sealing in the transition area at least for the upper portion of the sides of the transition duct section. The side walls 88 and 90 preferably capture the side walls of both the intake duct section and the fixed duct section throughout the swinging upward and downward movement of the boom 18.

The side plates 88 and 90 must be configured so that they provide sealing for the upper portion of the side walls of the duct transition section during all positions of the upward and downward movement of the boom. In order to facilitate total sealing of the side walls of the transition area of the duct system the rectangular fixed duct section 74 has a lower side wall extending portion 92 extending from both side walls 94 to ensure sealing of the bottom portion of the transition section. In the preferred embodiment the side walls 92 are located outwardly of the intake duct side walls and extend beyond the hinge connection portion 80 when the hinge 80 is at its furthest distance from the fixed duct 74 to ensure sealing throughout all movements of the boom. The shape of the lower extending portions 92 is predetermined so that it slidingly cooperates with the side walls 88 and 90 to seal the sides of the transition sections throughout all position of the boom 18.

As indicated above the preferred embodiment the side walls 88 and 90 of the transition section are positioned outside the side walls 94 of the fixed duct section 74. In the preferred embodiment the gap between the side walls 88 and 90 and the side walls 94 is approximately ⅛ inch or less. It has been found that this gap provides sufficient sealing so that leakage is not a problem.

In the preferred embodiment the bottom plate 76 slides on the inside surface of the bottom plate 96 of the generally rectangular duct 74. The length of plate 76 is sufficient so that it overlaps the bottom plate 96 through all upward and downward positions of the boom 18 and hinge connection 80.

As can be seen from the above description the preferred two piece transition section with hinge connections 80 and 86 provides sealing of the duct transition area throughout all positions of the upward and downward moving boom. It can be seen that the hinge joints 80 and 86 move through arcs B and C respectively as the boom rotates upwardly or downwardly. The arcs have their center at the pivot point A. As can be seen in FIG. 2 hinge joint 86 moves from position D to position E as the boom rotates from slightly below horizontal to its upper most vertical position. Similarly hinge joint 80 moves from position F to position G as the boom swings from its slightly below horizontal position to its upmost position. The movements of bottom plate 76 and of upper plate 82 and side walls 90 (which are fixed to plate 82) are shown in phantom on FIG. 2 when the boom is in its upper most position. It can be seen that there is line to line sealing contact between the plate 76 and the bottom plate 96 of duct 74 to seal the boom of the transition area. It can also be seen that at point 98 the plate 82 has line sealing contact with the upper plate 100 of duct section 74 to thereby seal the top of the transition area. As indicated above the cooperation of the side plates 88 and 90 and the extending portion 92 seal the side walls of the transition area. It can be seen that air leakage can occur only at the two piano hinges 80 and 86 and around the ⅛" gap between said plates 88 and sidewall 94 of duct 72. There is metal to metal contact between top plate 82 and the top plate 100 of duct 74 and also between bottom plate 76 and bottom plate 96 of duct 74. The metal to metal contact provides almost a complete seal of the transition section in these two areas. It can be seen that the leakage paths in the preferred embodiment are much less than either of the prior art environments shown in FIGS. 3 or 4 where there are several sliding joints (telescoping sections) having a ⅛" gap or less all around the duct section sides and several hinge connections.

In view of the above, it will be seen that the objects of the invention are achieved and other advantageous results obtained.

As various changes could be made in the above constructions without departing from the scope of the invention, it is intended that all matter contained in the above description are shown in the accompanying drawings shall be interpreted as illustrative and not in a limiting sense.

What is claimed is:

1. A mining machine comprising a vehicle body with a first end thereof having a boom pivoted for up and down swinging movement about an axis extending transversely of the vehicle, a cutter head carried by said boom, and means for carrying away material cut by said cutter head, a conveyor extending longitudinally of the vehicle for conveying material towards a second end of the vehicle, said cutter head when operated to cut causes dust to be present in the air at said first end of said vehicle said machine have a dust control system associated therewith including a duct work system, said duct work system comprising:

generally rectangular intake duct section associated with said boom and swingable up and down with said boom;

a generally rectangular fixed duct section extending longitudinally of said vehicle alongside said conveyor;

a transition duct section connecting said intake and said fixed duct sections, said transition duct section having a bottom plate hinged at one end to a bottom plate of said intake duct section and capable of having the end of said bottom plate opposite said hinged end slide on the inner surface of a bottom plate of said fixed duct section thereby sealing the bottom of said duct system as said boom rotates upwardly and downwardly, said transition section having a top plate hingedly connected to a top plate of said intake duct section and capable of sliding engagement with the outer surface of said top plate of said fixed duct section as said boom rotates upwardly and downwardly thereby sealing the top of said duct system in said transition area;

said transition section having a partial side plate member fixed to said top plate of said transition section and extending downwardly therefrom, said side plates slidingly engaging the side plates of said intake duct section and said fixed duct section in the area of said transition thereby sealing the sides of said duct system in said transition area during said boom rotation; and partial side portions extending from the lower portion of the side walls of said fixed duct section around said bottom plate of said transition section and the outer side walls of said intake duct section said partial side portions engaging said partial side plates of said transition section thereby sealing the duct system in the area of the sides of said transition section.

2. A mining machine as set forth in claim 1 wherein said lower portions of said side walls of said fixed duct section encompasses said hinge of said bottom plate member throughout all positions of said hinge during up and down movement of said boom.

3. A mining machine as set forth in claim 1 wherein said side plate members extend downwardly from said top plate to encompass and capture a part of said extending fixed duct partial side portions during said upward and downward movement of said boom.

4. A mining machine as set forth in claim 1 wherein the pivot point between said boom and said vehicle lies intermediate the extreme positions of the hinged connections of said top and bottom plate on said intake duct section as said boom moves upwardly and downwardly.

5. An improved duct system for a dust control system mounted on a mining machine, said mining machine of the type having a vehicle body including a boom mounted at a first end thereof, said boom pivoted for up and down swinging movement about an axis extending transversely of the vehicle, a cutter head carried by said boom, a means for carrying away material cut by the cutter head comprising a conveyor extending longitudinally of the vehicle for conveying said material back towards a second end of said vehicle, said cutter head when operated to cut causing dust to be present in the air at said first end of said vehicle, said dust control system of the type having a fan mounted on the vehicle for carrying said dust from said cutter head through a duct system out toward said second end of said vehicle, said duct system having an intake duct section associated with said boom and swingable up and down with said boom and a fixed duct section associated with the vehicle body, said improvement comprising:

a transition section connecting said intake duct and said fixed duct, said transition section having a bottom plate member having a first end hingedly attached to the bottom of said intake duct section, said plate having a second end capable of sliding on the inner surface of the bottom of said fixed duct section thereby sealing the bottom transition between said intake duct section and said fixed duct section;

a top plate member having a first end hingedly attached to the top plate of said intake duct section, said top plate having a second end thereof capable of sliding on the top surface of the top plate of said fixed section as said boom rotates thereby sealing the top of said transition section;

side plate members fixedly attached to said top plate and extending downwardly therefrom and surrounding the sides of said intake duct and said fixed duct in the area of said transition thereby sealing the top side portions of said transition section; and said fixed duct section having a bottom portion of said side walls thereof extending therefrom and capable engaging said side plate members of said top plate for sealing the entire side wall area of said transition section as said intake duct section swings upwardly and downwardly.

6. A mining machine as set forth in claim 5 wherein said bottom portion of said side wall of said fixed duct section encompasses said hinge of said bottom plate member throughout all positions of said hinge during up and down movement of said boom.

7. A mining machine as set forth in claim 5 wherein said side plate members extend downwardly from said top plate to encompass and capture a part of said bottom portion during said upward and downward movement of said boom.

8. A mining machine as set forth in claim 5 wherein the pivot point between said boom and said vehicle lies intermediate the extreme positions of the hinged connections of said top and bottom plate on said intake duct section as said boom moves upwardly and downwardly.

9. A mining machine comprising a vehicle body with a first end thereof having a boom pivoted for up and down rotational movement about an axis extending transversely of the vehicle, a cutter head carried by said boom, means for carrying away material cut by said cutter head, a conveyor extending longitudinally of the vehicle for conveying materials toward a second end of the vehicle, said cutter head when operated to cut causes dust to be present in the air and said first end of said vehicle, said mining machine having a dust control system mounted thereon including a fan and duct work system, said duct work system comprising:

a generally rectangular intake suct section associated with said boom and swingable up and down with said boom;

a generally rectangular fixed duct section extending longitudinally of said vehicle;

a two piece duct means having an upper and lower piece hinged tothe upper and lower plates of daid intake duct respectively and capable of slidingly engaging the upper and lower plates of said fixed duct section at the end thereof adjacent said boom, said upper piece of said two piece duct means includes downwardly extending side plates which sealingly encompass said fixed duct section to thereby sealingly join said intake duct section and said fixed duct section as said boom swings upwardly and downwardly.

10. A mining machine as set forth in claim 9 wherein said lower piece of said two piece duct means slides on the inner surface of said lower plate of said fixed duct means throughout upward and downward movement of said boom.

11. A mining machine as set forth in claim 9 wherein said fixed duct section has side walls of which a lower portion thereof extends beyond said generally rectangular intake section to facilitate said sealed joining of said intake and fixed duct sections.

12. A mining machine as set forth in claim 11 wherein said lower portion of said side wall of said fixed duct section encompasses said hinge of said lower duct piece throughout all positions of said hinge during up and down movement of said boom.

13. A mining machine as set forth in claim 12 wherein said upper duct piece side plate members extend downwardly from said upper duct piece to encompass and capture a part of said extending fixed duct lower side portions during said upward and downward movement of said boom.

* * * * *